US006135204A

United States Patent [19]

McCabe et al.

[11] Patent Number: 6,135,204

[45] Date of Patent: Oct. 24, 2000

[54] METHOD FOR PLACING INSTRUMENTATION IN A BORE HOLE

[76] Inventors: Howard Wendell McCabe, 8470 Pinecone Dr., Idaho Falls, Id. 83401; William Ernest McCabe, 1160 Stanger Ave., Idaho Falls, Id. 83404

[21] Appl. No.: 09/168,367

[22] Filed: Oct. 7, 1998

[51] Int. Cl.[7] ..... E21B 33/138; E21B 47/01

[52] U.S. Cl. ..... 166/250.17; 73/152.17; 166/66; 166/289; 166/295

[58] Field of Search ..... 166/66, 100, 101, 166/113, 187, 250.01, 250.17, 286, 289, 295; 73/152.17, 152.36, 866.5; 405/266, 269; 588/260

[56] References Cited

U.S. PATENT DOCUMENTS

| | | | |
|---|---|---|---|
| 4,356,629 | 11/1982 | Jeter et al. | 166/66 X |
| 4,484,626 | 11/1984 | Kerfoot et al. | 73/152.36 X |
| 4,662,442 | 5/1987 | Debreuille | 166/250.01 |
| 4,775,009 | 10/1988 | Wittrisch et al. | 166/66 X |
| 5,062,482 | 11/1991 | Graham | 166/250.01 |
| 5,303,773 | 4/1994 | Czernichow et al. | 166/66 |
| 5,353,873 | 10/1994 | Cook, Jr. | 166/66 X |
| 5,467,823 | 11/1995 | Babour et al. | 166/250.1 |
| 5,947,199 | 9/1999 | Havig | 166/250.01 |

*Primary Examiner*—George Suchfield
*Attorney, Agent, or Firm*—Risto A. Rinne, Jr.

[57] ABSTRACT

A method for placing probes, sensors, transducers, and other kinds of instruments in a bore hole is disclosed as including a sleeved-port piping system, also known as a tube-a-manchette, about which isolation packers are placed around selected sleeve-port locations. The instruments that are to be installed underground are attached to the exterior of the packers and the piping system is then lowered into the bore hole. A chemical grout injector is then lowered into the piping system and chemical components are supplied, under pressure, to the injector where they are reacted to produce a chemical urethane grout that is ejected from the injector out through an adjacent sleeved-port and into each of the packers. As the packer is filled with urethane grout it expands and tightly presses the instruments against the walls of the bore hole. The grout hardens and remains viable for decades of time. After all of the packers have similarly been filled with urethane grout, the injector is used to fill the annulus i.e., the remaining space between the outside of the piping system and the walls of the bore hole with additional urethane grout that is ejected from the piping system out through some or all of the remaining sleeved-ports, thereby sealing the bore hole. The injector is itself removed from the piping system.

27 Claims, 2 Drawing Sheets

METHOD FOR PLACING INSTRUMENTATION IN A BORE HOLE

BACKGROUND OF THE INVENTION

1. Field of the Invention

The present invention, in general relates to methods for placing instruments in bore holes and, more particularly, to methods for placing sensors and probes in direct contact with any of the surrounding strata of the bore hole.

There are potentially many reasons for placing sensors, probes, and various kinds of instrumentation in bore holes. Any geophysical property that one can wish to study is benefited by better placement techniques. Any subterranean measurement, such as temperature, movement of any kind, pressure, to name just a few are all candidates that benefit from improvements in the ability to place instruments.

One such area of investigation involves monitoring the flow characteristics of subterranean fluids. Monitoring the underground flow of water as well as chemical or radioactive contaminants is becoming increasingly more important. This information can be crucial to preventing the contamination of aquifers, and if it is reliable, it can be used to provide data that can in turn be used to plan and to augment mitigation techniques.

For example, the need for constructing underground barriers can be determined by having a sophisticated ability to measure minute underground fluid flow characteristics. If the flow of a contaminant can be detected and accurately mapped, then this data can be used in the formulation of abatement strategies.

For example, the type and size of an effective underground barrier that would be needed to contain the contaminants can be determined. Accurate monitoring is also useful in providing the ability to verify the efficacy of existing barriers and various other containment techniques. If, for example, the minute flow of contaminated fluids is better determined by improved sensor placement technologies, then the ability to monitor flows on both sides of an existing barrier will determine the efficacy of the barrier.

It is far better to know that an existing containment method, such as a barrier, has in fact failed than it is to falsely believe over time that it is working properly as potentially irreversible damage can then occur.

Prior techniques for placing instrumentation in bore holes have incurred many problems, some of which are so severe as to potentially invalidate the data that is acquired. The words "instrument" and "instrumentation", as used herein, are intended to refer to any piece of equipment that is to be placed underground and it includes all types of probes, sensors, transducers, and the like that can provide useful information of any kind.

As an example of problems encountered with prior art approaches, it is important to seal the entire bore hole after placement of instrumentation has occurred to prevent the accumulation of fluids in the hole. If fluid accumulates in the hole and surrounds the instrumentation (probes and sensors) the data they provide can be rendered suspect at best and in some cases even useless.

Prior art methods for placing instruments in a bore hole involve filling the bore hole with cement after the instruments have been placed. The technique for placing the instrumentation in the bore hole required attaching the instruments to an inflatable rubber bladder and lowering the bladder and instruments into the bore hole. The bag would then be inflated by pumping a gas through a tube into the bladder and then sealing off the tube at the surface. Cement would then be poured into the hole to fill it.

This approach has proven itself to not be reliable because the inflatable bladder can leak over time, thereby pulling the instruments away from a position of contact with the bore hole wall. If this occurs, all of the data that is collected is based upon factors that no longer exist (the assumption that the instruments are held in contact with the wall under pressure), and is therefore all invalid.

Furthermore, the cement does not provide a water-tight seal of the bore hole and fluids can accumulate in general proximity to the instruments and can even surround the instruments. If water accumulates proximate the instruments this thereby falsifies both the conditions as well as the data that is provided by the instruments.

Furthermore, fluids can migrate around the cement and pass through the bore hole in such fashion as to create new paths for their migration. In particular a fracture that is conducting a contaminated fluid near the top of the bore hole can convey the fluid through the bore hole to another separate fracture that is disposed lower in the bore hole. The contaminated fluid can continue to migrate as a result of the bore hole when it otherwise could not have done so because the cement does not provide a perfect seal of the interior of the bore hole. This is a potentially serious problem in that the bore hole (well) that is intended only to supply data can actually contribute to the problem of fluid migration.

The cement is also susceptible to erosion and deterioration. Acidic conditions, such as often occur with contaminated fluids and especially radioactive contaminants, can hasten the process. Therefore the prior art instrument placement techniques in bore holes has incurred many problems and a poor track record involving their long-term performance.

Also, the prior techniques do not provide any way to service or maintain the bore hole. Once the cement has been poured, there is no way to add extra cement, for example, somewhere along the length of the bore hole, should that become desirable. This might occur if erosion has removed some of the cement or if settling has occurred or if a traumatic event, such as an earthquake, has occurred.

Accordingly, there exists today a need for an improved method for placing instrumentation in a bore hole. Clearly, such a method would be useful and desirable.

2. Description of Prior Art

Methods for placing instrumentation in bore holes are, in general, known. The preceding discussions are believed to well describe the current known state of the art.

While the structural arrangements of the above described devices and methods may, at first appearance, have similarities with the present invention, they differ in material respects. These differences, which will be described in more detail hereinafter, are essential for the effective use of the invention and which admit of the advantages that are not available with the prior devices and methods.

OBJECTS AND SUMMARY OF THE INVENTION

It is an object of the present invention to provide a method for placing instrumentation in a bore hole that improves either the accuracy or the reliability of the data that is acquired from the instrumentation.

It is also an important object of the invention to provide a method for placing instrumentation in a bore hole that is resistant to acids.

Another object of the invention is to provide a method for placing instrumentation in a bore hole that maintains, over time, the instrumentation in contact with the surrounding walls (i.e., the surrounding strata) of the bore hole.

Still another object of the invention is to provide a method for placing instrumentation in a bore hole that does not rely upon the use of a pneumatic bladder that can leak and fail over time to fulfill its function to maintain the instrumentation in contact with the surrounding strata.

Still yet another object of the invention is to provide a method for placing instrumentation in a bore hole that effectively seals the bore hole after the instruments have been placed.

Yet another important object of the invention is to provide a method for placing instrumentation in a bore hole that is reliable.

Still yet another important object of the invention is to provide a method for placing instrumentation in a bore hole that can be maintained (serviced) over time.

Briefly, a method for placing instrumentation in a bore hole that is in accordance with the principles of the present invention has at least one instrument attached to at least one isolation packer. The isolation packer is attached to one of the ports of a "tube-a-manchette", a well known type of a "sleeve port" piping system. The instrumentation and tube-a-manchette is lowered into a bore hole. Urethane grout is injected through the sleeve port to fill and expand the isolation packer, thereby forcing the instrumentation into contact with the structures that surround the bore hole. Additional urethane grout is injected through other sleeve ports that are disposed above and below the isolation packer to fill the annulus intermediate the tube-a-manchette and the structure that surrounds the bore hole.

DETAILED DESCRIPTION OF THE INVENTION

Figure 1:
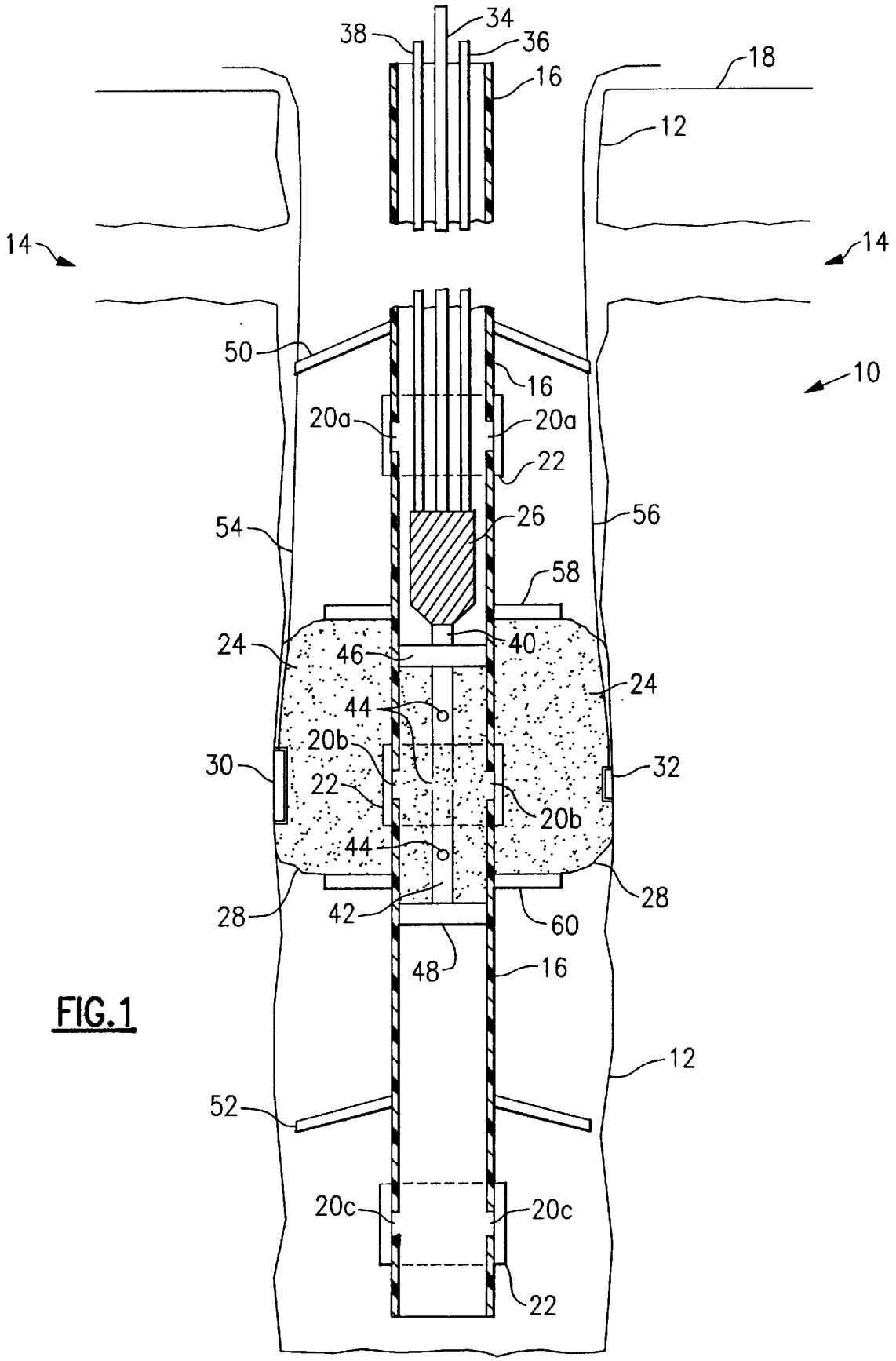
FIG. 1 is a cross sectional view of a tube-a-manchette (sleeve-port) type of a piping system showing a three-component chemical grout injector that is used to inject grout as part of a method that is used to place sensors and probes adjacent to a wall of a bore hole in accordance with the principles of the invention.

Referring to FIG. 1 is shown, a method and related apparatus for placing instrumentation in a bore hole 12, the entire method being identified, in general, by the reference numeral 10.

A missing section of the bore hole, identified in general by the reference numeral 14, is not shown. The missing section 14 is of any length as desired and may contain many locations for placing instrumentation along the length thereof, each similar to that as is described in greater detail hereinafter.

A tube-a-manchette 16 begins near a surface 18 and extends as close to a bottom of the bore hole 12 as desired. The tube-a-manchette 16 is a common name for a "sleeve-port" or "sleeved-port" type of piping system. It includes sections of pipe that are assembled together (either as a unit at the surface 18 or section by section as the tube-a-manchette 16 is lowered into the bore hole 12) typically by gluing them together.

The tube-a-manchette 16 is usually formed of plastic (typically, PVC) but it could be formed from any desired material such as steel, acrylic, or synthetic materials. Various strengths (known as schedules) of the tube-a-manchette 16 are available depending upon the conditions of the bore hole. For example, if the bore hole is slanted (See FIG. 2) a heavier schedule pipe for construction of the tube-a-manchette 16 may be desired to handle the increased stresses.

For certain applications involving great working depths such as may be encountered in special situations involving, for example, radioactive wastes that have migrated to great depths, steel or other special or exotic materials (graphite or other synthetic compounds) may be required to form the pipe of the tube-a-manchette 16.

It should be noted that steel is not normally a preferred material for use as the pipe of the tube-a-manchette 16 because steel can affect the performance of certain of the instruments and also because it is subject to deterioration by a number of factors including oxidation, galvanic action, and the like.

A plurality of ports (shown as a first port 20*a*, a second port 20*b*, and a third port 20*c*) are included along the length of the tube-a-manchette 16. While only three ports 20*a,b,c* are shown, in normal use many more are present as is described in greater detail hereinafter.

A plurality of rubber sleeves 22 fit snugly around the exterior of the tube-a-manchette 16 pipe and surround each of the respective ports 20*a,b,c* at each of the port 20*a,b,c* locations. The sleeves 22 are also known as "manchettes" and their function is to each act as a one-way check valve over each of the ports 20*a,b,c*.

Typically, the sleeves 22 will allow a grout (identified by the reference numeral 24 and as is discussed in greater detail hereinafter) to be ejected out of any of the ports 20*a,b,c* as desired while preventing the entry of either the grout 24 that has already been ejected or any other materials or fluids that may be disposed on the exterior of the tube-a-manchette 16 back into the tube-a-manchette 16.

The diameter of the tube-a-manchette 16 can vary from under an inch to several inches, or more if required. Typical outside diameters approximate two inches for most common types of applications.

A three-component chemical grout injector 26 is disposed in the tube-a-manchette 16 and is used to formulate optimum characteristics of the grout 24. A pending application for United States Letters Patent by the same inventors discloses the construction and design of the three-component injector 26 in greater detail. That aforementioned related application is entitled "Three Component Chemical Grout Injector", its serial number is Ser. No. 09/121,748, and it was filed on Jul. 23, 1998. For the purposes of this application, the three-component injector 26 allows great flexibility in creating the desired grout 24 and is included in this document to illustrate the "best mode" for bringing forth the invention. The advantages and use of the injector 26 is discussed in greater detail hereinafter.

The grout 24 is a urethane (also known as a "polyurethane") chemical grout and is well known in the drilling and related crack and crevice sealing arts. Urethane is especially well suited for placing instrumentation because its characteristics, including the amount that is injected (the amount that is reacted together and the resultant amount of grout that is ejected from the tube-a-manchette 16) can be predicted and therefore precisely controlled.

As is discussed in greater detail hereinbelow, this is useful in inflating an isolation packer 28 to a predetermined volume (and pressure) of the grout 24. This, in turn, allows for regulation of the force that the instrumentation, as is discussed in greater detail hereinbelow, experiences as it is forced into contact with the wall of the bore hole 12.

Also, urethane as the grout 24 provides a water-tight seal and resists deterioration, especially from acids. It also does not interfere with various sensing technologies that may be used. In the FIG. 1 drawing, a first sensor 30 and a second sensor 32 are shown, each respectively attached to opposite sides of the isolation packer 28.

Any number (quantity) of the sensors 30, 32 may be attached to the isolation packer 28. Additional packers (not shown) can of course also be used at different locations along the tube-a-manchette 16. When the additional packers are used an additional quantity of the sensors 30, 32 can of course be attached to them to provide data by monitoring various locations (depths) along the longitudinal length of the tube-a-manchette 16. Only the one isolation packer 28 is shown as it well illustrates the process and is repeated at whatever depth (location) in the bore hole 12 is desired.

It is of little consequence to the placement methods that are described herein what technologies the first and second sensors 30, 32 utilize, other than to mention that if their reliability, accuracy, or performance can in any way be improved by ensuring that they are in contact with the wall of the bore hole 12, then they are candidate technologies. To highlight two benefits of this method that were mentioned earlier, both the PVC of the tube-a-manchette 16 as well as the characteristics of the grout 24 have been found to harmonize with the requirements of the sensors 30, 32.

Obviously, depending upon what it is that is to be measured or studied, this will determine what future measurement techniques, technologies, and equipment will be developed and which of those can benefit from the placement methods as herein described.

It is of consequence to note that for certain measurement technologies the use of either cement to fill the well or the use of steel pipes (casings) can interfere with the measurement technologies to an undesirable degree.

While the methods described herein can be used with all kinds of instrumentation, it is of benefit to illustrate some of the potential measurement sciences that will benefit from improved placement techniques. Therefore, the following geophysical data acquisition methods are mentioned as but a few of the candidate technologies: acoustical measurements including sonar techniques, temperature measurements, pressure measurements, electrical resistance measurements, ground penetration radar, and neutron logging. It is in no way intended to limit the utility of the methods disclosed and claimed to the placement of any particular type of transducer.

The words "instrument," "instrumentation," "probe", "transducer", and "sensor" all refer to any type of device useful to monitor a property and are all represented by either the first or the second sensor 30, 32. The words "urethane" and "polyurethane" are similarly interchangeably used. The term "bore hole 12" is also sometimes referred to as a "well" in the industry.

The bore hole 12 (well) is formed by various well-known drilling technologies (for example, core drilling) and does not need to be discussed other than to mention that it is provided having a predetermined diameter and depth sufficient to insert the tube-a-manchette 16, the isolation packer 28, and the first and second sensors 30, 32 as desired and as are discussed in greater detail hereinafter.

Although it is not always essential to use the three-component injector 26 for certain instrument placement applications that will benefit from and rely upon the methods herein disclosed and claimed, it is usually preferred and is therefore included in this description as mentioned earlier as being the best mode for bringing forth the invention. This is because the precise characteristics of the grout 24 that is produced can best be regulated (controlled) by being able to inject and vary three or more components simultaneously, as is the case with the three-component injector 26.

For example, the isolation packer 28 is shown filled with the grout 24. The method by which it is filled is discussed in greater detail hereinbelow. A preferred formulation to create the grout 24 that is used in the isolation packer 28 includes the use of two grout components manufactured by the firm of Strata Tech, Inc., and is sold under the product labels of "ST-530" and "ST-531". ST-530 is used for approximately 90% of the formulation and ST-531 for about 10%.

It is necessary to add a minute amount of water (as the catalyst) to the ST-531 the moment it enters the three component injector 26 to properly combine and react with the ST-530. An ideal strength, hardness, and volume of the resulting grout 24 is then produced and in particular would not be produced if the water were otherwise added sooner or later or other changes to the formulation were to occur. Of course, other formulations can be developed or used to position other sensors as needed. This example is included to show that the use of the three-component injector 26 is generally preferred.

Similarly, that is why a first pipe 34, a second pipe 36, and a third pipe 38 supply components through the tube-a-manchette 16 to the three-component injector 26. The first pipe 34 is typically formed of steel sections that thread together so provide for a precise method of placing the three-component injector 26 in the proper position with respect to any of the ports 20*a,b,c*.

This is accomplished by measuring the length of the combined sections of the first pipe 34 and comparing that with the length of the tube-a-manchette 16 and the locations of the ports 20*a,b,c* along that length to set the injector 26 at the proper depth. The first pipe 34 also functions as a conduit to supply a desired component (usually water as a catalyst) under pressure to the three-component injector 26.

The second and the third pipes 36, 38 supply other components as needed under pressure and in the proper amounts to the three-component injector 26. The second and the third pipes 36, 38 are each preferably formed of a continuous length of flexible piping.

In general, the resin and the catalyst pass through the first, second, or third pipes 34, 36, 38 and reach the three component injector 26 where valves open internal to the injector 26 and where they combine in such manner as to properly react and produce the urethane grout 24. A spiral mixer 40 is attached to the three component injector 26 at an end opposite to where the pipes 34, 36, 38 are attached.

The spiral mixer 40 is a well known device that mixes the components to provide a more complete chemical reaction and therefore, to produce the grout 24 having more uniform and desired characteristics. Attached to the spiral mixer 40 is a ported pipe 42. The ported pipe is sealed at the bottom and includes a plurality of port holes 44 to allow the grout 24 to escape from the three-component injector 26.

An upper packer 46 and a lower packer 48 are disposed at the top and bottom ends of the ported pipe 42 providing a seal intermediate the ported pipe 42 and the inside diameter of the tube-a-manchette 16. As additional components are pumped to the injector 26, they are reacted and produce additional quantities of the grout 24 that is forced out of the ported pipe 42. This results in an increase in pressure in the area that surrounds the ported pipe 42 and which is contained by the interior walls of the tube-a-manchette 16 and the upper and lower packers 46, 48. The grout 24 is ejected from the tube-a-manchette 16 to fill the isolation packer 28 and is described in greater detail hereinbelow.

An upper centralizer 50 and a lower centralizer 52 are attached around the tube-a-manchette 16 at periodic intervals and are intended to keep the tube-a-manchette 16 centrally located in the bore hole 12 as it is lowered therein. The detail of construction of each of the centralizers 50, 52 varies according to the requirements of the application and include segmented (finned) devices as well as round disks. These types of devices are also well known in the arts.

They are also used, according to the invention, to fulfill another function and that is to function as a means to secure a first conduit 54 and a second conduit 56. The first and second conduits 54, 56 emanate respectively from the first and second sensors 30, 32 and are used, typically, to supply electrical power to the sensors 30, 32 and/or to obtain the data that the sensors 30, 32 provide.

The first and second conduits 54, 56 will usually include electrical wiring, but are not so limited and can include any media as may be desired. For example, fiber optic or fluidic interfaces to the sensors 30, 32 may be required. In any event, the centralizers 50, 52 can be used to safely secure and therefore to route the conduits 54, 56 from the sensors 30, 32 to their final destination above the surface 18.

The isolation packer 28 includes a flexible bag or container that is formed of plastic (polyethylene) or any similar type of material that can be used to contain the grout 24 and is attached to a top ring 58 and to a bottom ring 60 so as to form a seal around the exterior of the tube-a-manchette 16. The top and bottom rings 58, 60 extend fully and tightly around the outside diameter of the tube-a-manchette 16, the top ring 58 above (on one side of) the second port 20*b* and the bottom ring 60 below (on the opposite side of) the second port 20*b*.

As mentioned hereinbefore, the sensors 30, 32 are attached to the exterior of the isolation packer 28. The manner by which they are attached is variable. If it is preferred, the sensors 30, 32 can be formed and assembled using any manufacturing technique so that they are an integral component with the isolation packer 28 (Appropriate when the isolation packer 28 is manufactured for the express purpose of attaching the sensors 30, 32 thereto.).

The isolation packer 28 is a known device for use in grouting technologies that has been used exclusively in the past to isolate certain areas of the bore hole 12. Typically, more than one isolation packer 28 is used when a tube-a-manchette 16 is used to supply grout to fill voids and crevices with the urethane grout. In prior art applications, no instrumentation (sensors 30, 32) were attached to any of the isolation packers 28. The isolation packers 28 are merely filled with a urethane grout so as to form a seal intermediate the tube-a-manchette 16 and the walls of the bore hole 12.

Then, additional grout is injected through other ports of the tube-a-manchette 16 to seal crevices and voids, as well as the space (annulus) that is disposed around the exterior of the tube-a-manchette 16 and intermediate each of the isolation packers 28 and the walls of the bore hole 12. As such, the isolation packers 28 "isolate" areas along the longitudinal length of the tube-a-manchette 16 so that these areas can be grouted individually. Hence, the name "isolation packer" is given to these kinds of devices.

Therefore, when prior existing and well known types of the isolation packer 28 are used with the present invention it does indeed become necessary to attach the sensors 30, 32 to the isolation packer 28. Typically, they will be attached to the exterior of the isolation packer 28 so that they will come in direct contact with the walls of the bore hole 12 when the packer 28 is filled with the grout 24. The sensors 30, 32 are attached by whatever means is preferred.

For example, they (the sensors 30, 32) can be taped, glued, or tied; whatever works to keep them in the desired position long enough to lower them into position and fill the isolation packer 28 with the grout 24. After that, when the grout 24 hardens, the isolation packer 28 will for years, even decades, maintain its state of contact with the walls of the bore hole 12. Accordingly, so will the sensors 30, 32 long maintain contact with the walls of the bore hole 12.

By controlling the formulation of the grout 24 and also the volume of components that are chemically reacted to produce the grout 24, the amount of the grout 24 produced is also controlled. This, in turn, allows for predicting and controlling the pressure that develops within the isolation packer 28 as its volume is known as is the size of the bore hole 12.

This method of placing instrumentation in the bore hole 12 provides a significant improvement over all known prior methods in that the present invention is immune to any leakage that may later develop in the isolation packer 28. This was not the case with prior types of inflatable bladders.

If by some odd occurrence, the isolation packer 28 were to develop a puncture, the grout 24 that is contained therein would not exit from the packer 28. This is because the final consistency of the grout 24 that is formed is itself a variable. A less-viscous (harder, more rigid) formulation for the grout 24 is preferred for use in the isolation packer 28. As was mentioned hereinabove, the use of the three-component injector 26 allows for optimum control over this (and other) grout formulations as is discussed in greater detail hereinbelow.

If there was a special circumstance where it was believed that a special sensor (not shown) would benefit by placement inside of the isolation packer and by attachment to the inside surface thereof, that can also be accomplished. In that unique situation, the isolation packer 28 would again be filled with the grout 24 and the special sensor would then be forced into contact with the wall of the bore hole 12 but with the material that forms the isolation packer 28 acting as an interface therebetween. It is not known when this approach would be desirable, however, it is mentioned as a possible application of the methods herein described.

The process by which the sensors 30, 32 are set in place include assembly at the surface 18 of the tube-a-manchette 16. The tube-a-manchette 16 can be assembled as a unit and then lowered into the bore hole 12 or it can be assembled and lowered, one section at a time. The isolation packer 28 can be placed at any location or number of locations that surround one of the many ports 20*a,b,c* and therefore so can the sensors 30, 32 be located where desired as they are attached to the packer 28 at the surface.

As the tube-a-manchette 16 is assembled, the centralizers 50, 52 are added and the first and second conduits 54, 56 are also added and are routed accordingly through the centralizers 50, 52 to hold them (the conduits 54, 56) in position.

As many of the isolation packers 28 as are needed to place all of the sensors 30, 32 at the proper depths are used. Of course, the top and bottom rings 58, 60 are also added during assembly of the tube-a-manchette 16, one each of the rings 58, 60 being disposed above and below the desired sleeve port (20*b* in the FIG. 1 drawing) wherever the isolation packer 28 is to be installed on the tube-a-manchette 16.

The centralizers 50, 52 keep the tube-a-manchette 16 centered in the bore hole 12 as it is lowered. The three-component injector 26 is then lowered so as to align the ported pipe 42 adjacent to the second sleeved port 20*b*. The upper packer 46 and the lower packer 48 surround the second port 20*b*. When the grout components (resin and catalyst) are pumped down to the three-component injector 26, they react and combine to produce the grout 24, as was described hereinabove. The grout 24 continues to fill the space around the ported pipe 42 increasing pressure until the sleeve 22 surrounding the second port 20*b* is pushed open and the grout exits from the tube-a-manchette 16 to fill the isolation packer 26 and cause the sensors 30, 32 to be pressed against the wall of the bore hole 12.

The components are stopped and the three-component injector 26 is then either raised or lowered as desired to align the ported pipe 42 with the remaining ports 20*a* or *c*. If there were other isolation packers having other sensors attached thereto, they would be filled next.

Finally, after all of the isolation packers 28 have been filled with the grout 24, the three-component injector 26 is moved to fill in the intermediate spaces (annulus). It is lowered so that the ported pipe 42 aligns with the third port 20*c* and a second grout formulation is pumped to the injector 26 and exits through the third port 20*c* where it is used to fill the space from the bottom of the bore hole 12 to the bottom of the isolation packer 28 intermediate the tube-a-manchette 16. (This space is known as the "annulus" and it is shown in the FIG. 2 drawing as being filled with a second grout formulation, identified by the reference numeral 124 in that figure.)

Then, the injector 26 is raised to align the ported pipe 42 with the first port 20*a*, and the second grout formulation (124) is injected out of first port 20*a* to fill the annulus from the top of the isolation packer 28 to the surface 18 intermediate the walls of the bore hole and the tube-a-manchette 16. The three component injector 26 is then removed from the tube-a-manchette 16.

As such the bore hole 12, except for the space inside of the pipe of the tube-a-manchette 16, is completely filled with grout. This provides a complete seal and prevents water or other fluids from accumulating around the sensors 30, 32 as a result of having the bore hole 12. In addition, if it ever becomes necessary to maintain the bore hole 12 by injecting more grout, this can be done by once again inserting the injector 26 so that the ported pipe 42 aligns with whatever port 20*a,b,c* is in need of having more grout injected. More components are then pumped to the injector 26 where they are reacted, causing an increase in pressure sufficient to inject more grout (of whatever formulation is preferred) wherever it is wanted. This is useful if settling, erosion, or trauma (such as earthquake or explosives) were to occur at or near to the bore hole 12.

Figure 2:
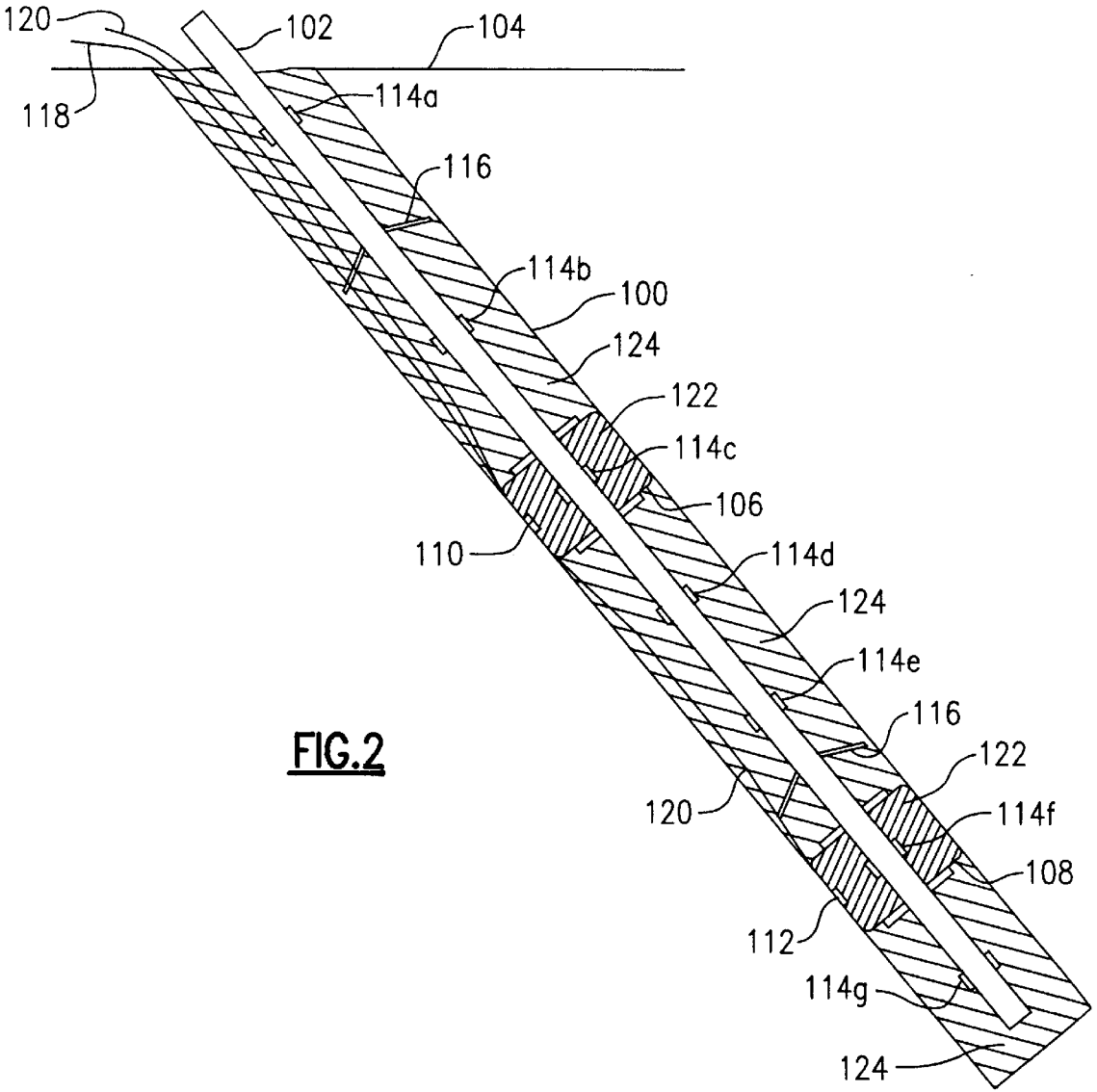
FIG. 2 is a cross-sectional view of a slanted bore hole that, showing the completed installation, has had various probes properly placed against the bore hole wall and has had the bore hole properly sealed.

Referring now to FIG. 2, is shown a slanted bore hole 100 with a second tube-a-manchette 102 therein disposed and a second surface 104. A first isolation packer 106 is disposed above a second isolation packer 108, having a first and second probe 110, 112 respectively attached thereto. A number of ports are not visible in this drawing because they are each covered by their respective manchette sleeves 114*a–g*.

Two centralizers 116 route a first and a second wire 118, 120 that are respectively attached to the first and second probes 110, 112.

A first grout formulation 122 has been used to fill each of the packers 106, 108 and a second grout formulation 124 has been used to fill the intermediate annulus areas, in each case by injecting the desired grout (122 or 124) through the appropriate port and past the respective manchette 114*a–g*. The three-component injector 26 as was discussed hereinabove is used for this purpose and it has been removed from the second tube-a-manchette 102.

The second grout formulation 124 is typically more flexible than the first formulation 122 and is useful to allow some settling to occur, and to better adhere to the dirt that typically surrounds the slanted bore hole 100. It is noted that urethane grout does a superb job of adhering to the dirt that surrounds the typical bore hole 12 of FIG. 1 and that this characteristic also tends to make the use of urethane grouts especially well suited for placing instruments in wells, generally. Being less brittle, the second grout formulation 124 is less likely to crack and separate from the dirt or to otherwise allow a path for any fluid to enter.

As shown, the slanted bore hole 100 has had the probes 110, 112 placed in contact with the walls of the bore hole and the remainder of the bore hole 100 has been filled with grout (the second formulation 124). If desired, the probes 110, 112 could have been disposed anywhere on the periphery of the first and second packers 106, 108.

The invention has been shown, described, and illustrated in substantial detail with reference to the presently preferred embodiment. It will be understood by those skilled in this art that other and further changes and modifications may be made without departing from the spirit and scope of the invention which is defined by the claims appended hereto.

What is claimed is:

1. A method for placing instrumentation in a bore hole, which comprises:

(a) attaching at least one sensor to a flexible container;

(b) lowering said container into said bore hole; and (c) injecting a urethane grout to fill at least a portion of said container with said grout sufficient to force said at least one sensor proximate a wall of said bore hole.

2. The method of claim 1 wherein said flexible container includes an isolation packer.

3. The method of claim 1 wherein said at least one sensor includes a probe.

4. The method of claim 1 wherein said at least one sensor includes a transducer.

5. The method of claim 1 wherein said at least one sensor includes an instrument adapted for receiving a signal.

6. The method of claim 1 including the step of injecting an additional urethane grout proximate an exterior of said container.

7. The method of claim 1 including the step of placing means for injecting a urethane grout proximate said container.

8. The method of claim 7 wherein said means for injecting includes using at least a three-component grout injector.

9. The method of claim 1 including the step of placing a tube-a-manchette piping system into said bore hole, said piping system including at least one sleeved-port.

10. The method of claim 9 including the step of attaching said container to said piping system proximate one of said at least one sleeved-port in such manner so that when a grout is ejected from said one of said at least one sleeved-port, it enters into said container.

11. The method of claim 10 including the step of attaching a plurality of containers to said piping system.

12. The method of claim 11 including the step of attaching an additional sensor to any of said plurality of containers.

13. The method of claim 10 including the step of ejecting an additional grout from another of said at least one sleeved-port that is disposed proximate to said one of said at least one sleeved-port to fill an area intermediate an exterior of said piping system and said bore hole that is proximate to said container.

14. The method of claim 13 wherein said additional grout is ejected below said container.

15. The method of claim 13 wherein said additional grout is ejected above said container.

16. The method of claim 13 wherein said additional grout is ejected above and below said container sufficient to fill an annulus of said piping system, said annulus including that space intermediate said exterior of said piping system and said bore hole excluding the area that is occupied by said container and said at least one sensor.

17. The method of claim 16 including the step of attaching a plurality of containers to said piping system and wherein said annulus excludes the area that is occupied by said plurality of containers.

18. The method of claim 17 including the step of servicing said bore hole after said additional grout has been ejected to fill said annulus.

19. The method of claim 18 including the step of inserting means for injecting said grout into said piping system and of injecting a second additional grout through any of said at least one sleeved-port.

20. The method of claim 9 including the step of inserting means for injecting said grout into said piping system.

21. The method of claim 20 including the step of aligning said means for injecting proximate any of said at least one sleeved-port and of ejecting said grout therefrom.

22. The method of claim 1 wherein said bore hole is disposed vertical with respect to a horizontal plane of the earth taken at the surface of said bore hole.

23. The method of claim 1 wherein said bore hole is disposed at an angle that is offset from vertical with respect to a horizontal plane of the earth taken at the surface of said bore hole.

24. A method for placing instrumentation in a bore hole, which comprises:

(a) attaching at least one sensor to a flexible container;

(b) attaching said container to a sleeved-port piping system, said system having a plurality of sleeved-ports and having said container disposed proximate one of said plurality of sleeved-ports so that when a urethane grout is ejected therefrom it fills and expands said container;

(c) lowering said piping system into said bore hole;

(d) inserting means for injecting a grout into said piping system proximate said one of said plurality of sleeved-ports; and (c) ejecting said urethane grout from said means for injecting to fill at least a portion of said container with said urethane grout sufficient to force said at least one sensor proximate a wall of said bore hole.

25. The method of claim 24 including the step of moving said means for injecting proximate another of said plurality of sleeved-ports.

26. The method of claim 25 including the step of ejecting an additional quantity of grout through said another of said plurality of sleeved-ports.

27. The method of claim 24 including the step of attaching at least one centralizer to said piping system before lowering said piping system into said bore hole.

* * * * *